United States Patent [19]

Nawrath

[11] 4,411,046

[45] Oct. 25, 1983

[54] MULTI-PINTLE HINGE WITH RACK AND PINION SLIDE

[75] Inventor: Peter Nawrath, Remscheid, Fed. Rep. of Germany

[73] Assignee: Julius Blum Gesellschaft m.b.H., Hochst, Austria

[30] Foreign Application Priority Data

Jan. 15, 1980 [AT] Austria ..... A 182/80

[21] Appl. No.: 224,923

[22] Filed: Jan. 14, 1981

[51] Int. Cl.[3] ..... E05D 15/08

[52] U.S. Cl. ..... 16/354; 16/358

[58] Field of Search ..... 16/370, 358, 354, 360, 16/361, 368

[56] References Cited

U.S. PATENT DOCUMENTS

| | | | |
|---|---|---|---|
| 2,348,348 | 5/1944 | Krause | 16/361 X |
| 3,234,584 | 2/1966 | Valade | 16/370 |
| 3,978,549 | 9/1976 | Vitt | 16/358 X |
| 4,188,684 | 2/1980 | Pennec | 16/358 X |

FOREIGN PATENT DOCUMENTS

| | | |
|---|---|---|
| 1958983 | 6/1971 | Fed. Rep. of Germany . |
| 2756319 | 6/1971 | Fed. Rep. of Germany . |
| 2204828 | 8/1973 | Fed. Rep. of Germany . |
| 480525 | 12/1969 | Switzerland . |

*Primary Examiner*—Werner H. Schroeder
*Assistant Examiner*—Andrew M. Falik
*Attorney, Agent, or Firm*—Angelo Notaro

[57] ABSTRACT

A hinge for opening a door up to an angle of about 180° includes a mounting plate and a hinge casing connected by two hinge arms. The movement of the hinge arms with respect of each other is controlled by a rack and pinion arrangement. One hinge arm carries the pinion and this hinge arms is guided at two points of connection in guiding grooves in the mounting plate.

14 Claims, 13 Drawing Figures

MULTI-PINTLE HINGE WITH RACK AND PINION SLIDE

BACKGROUND OF THE INVENTION

1. Field of the Invention

This invention relates to a hinge having an opening angle of about 180° and including a base plate fastenable to a wall of the piece of furniture and a hinge casing or the like fastenable to a door wing and, for example, insertable into a drill hole in the door wing. The base plate and hinge casing are linked to each other by means of hinge arms, the first of the hinge arms being movable in guiding grooves or the like in the base plate or in an intermediate member fastened to the base plate, the second of the hinge arms being coupled to a slide on the side of the base plate. The slide is movably guided in the longitudinal direction in the first hinge arm. The first hinge arm is provided with at least one, preferably two toothed wheels, the wheel or wheels meshing with racks on the base plate or the intermediate member and on the slide.

2. Description of the Prior Art

Hinges of this kind are used in furniture constructions, when the door should be opened by more than 90° in order to ensure a better access to the interior of the piece of furniture. When fully opened, the door should be spaced from the body of the piece of furniture in order to prevent it from pushing against an adjacent door.

In conventional hinges, the large opening angle is obtained by means of crossed hinge arms or links.

Such hinges have the disadvantage that the hinge arms or links protrude far into the interior of the piece of furniture when the hinge is closed, so that storage space is lost.

With hinges in which the two hinge arms are linked by a toothed wheel by means of racks, thus obtaining a very flat design, considerable space between adjacent doors is necessary as the function of such hinges is similar to that of a one-axle hinge.

Examples of the prior art arrangement mentioned above are shown in Swiss Pat. No. 480 525 and West German DE-AS 1 958 983 and DE-OS 2 204 828 and 2 756 319.

SUMMARY OF THE INVENTION

It is, therefore, the object of the invention to provide a hinge of the afore-described type, with an opening angle of about 180°, of extremely flat design and having the same advantages and at least approximately the same course of motion as conventional four-axle hinges.

According to the invention, this is achieved by guiding the first hinge arm carrying the toothed wheel or wheels in its longitudinal direction in a slide way or slide ways by means of two points of connection and by guiding at least one of such points of connection in a curved slide way.

A preferred embodiment of the invention provides that the first hinge arm carrying the toothed wheels is at the toothed wheels guided in a slide way of the base plate curved with respect to the mounting plane, the rack or racks of the base plate being adapted to the curvature of such slide way.

By means of this arrangement, the door is, during the opening process, spaced from the furniture side wall in a direction normal to the side wall.

Hence, the opening of the door is not impeded, even when a second door or a wall lies adjacent thereto. The slide way is preferably formed by two slots on both sides of the base plate, the axle of the toothed wheel or wheels extending through such slots. The axle is one point of connection.

Optimal guiding of the door is obtained in that the vertex of the slide way coincides with that point of the slide way which is farthest from the mounting plane of the base plate.

The slide is advantageously mounted by providing it with lateral flanges extending into grooves in the hinge arm, or vice versa, by arranging the grooves in the slide and the lateral flanges on the hinge arm.

A further advantageous embodiment of the invention provides that the hinge arm carrying the slide comprises two members, i.e. two lateral members linked to each other by means of axles, one of the axles being the bearing axle of the toothed wheels. Each axle forms one point of connection.

It preferably provided that the hinge arm coupled to the slide is on the side of the hinge casing fastened to a seat of the hinge casing, such seat projecting from the hinge casing. It further is provided that the base plate is at its front face provided with a recess into which the seat of the hinge casing extends when the hinge is closed.

The recess in the base plate is dimensioned in such a manner that the side walls of the recess form lateral guides for the inserted seat. When the hinge is in the closed position, the weight of the door wing does not exclusively rest on the hinge axles.

By means of this arrangement, the stability of the closed hinge is substantially increased.

Optimal guiding of the hinge arms is obtained by adapting the slide way to rise from the mounting plane of the base plate towards the rear end of the base plate. The first hinge arm is, at its end directed away from the hinge casing, movably guided in the slide way in a conventional manner.

BRIEF DESCRIPTION OF THE DRAWINGS

In the following various embodiments of the invention will be described in greater detail with reference to the accompanying drawings, without being limited thereto, and wherein.

DETAILED DESCRIPTION OF THE INVENTION

Figure 1:
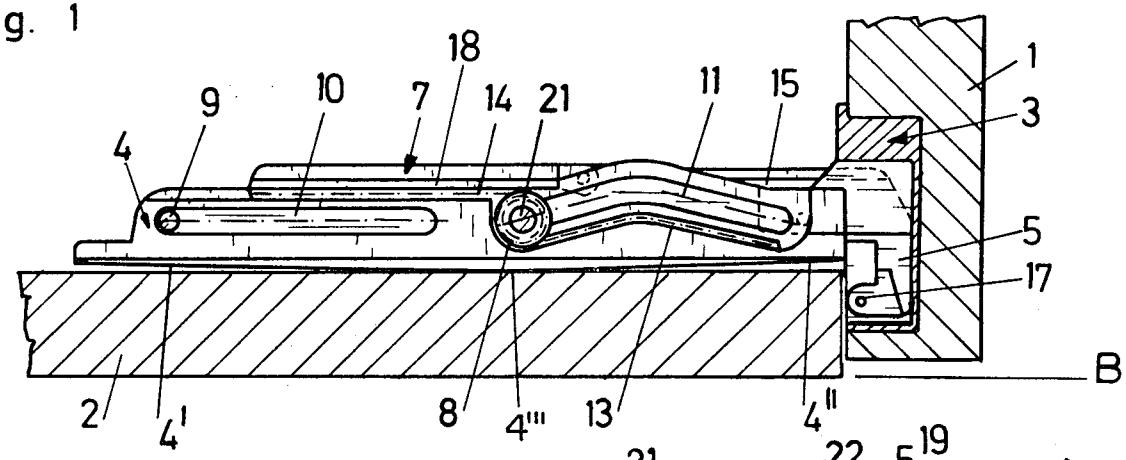
FIGS. 1 through 6 are schematic side views of an embodiment of the hinge of the invention, shown in different positions, from the closed position to the maximum opened position, one side of the hinge arm not being shown for reasons of clarity of illustration.
Figure 2:
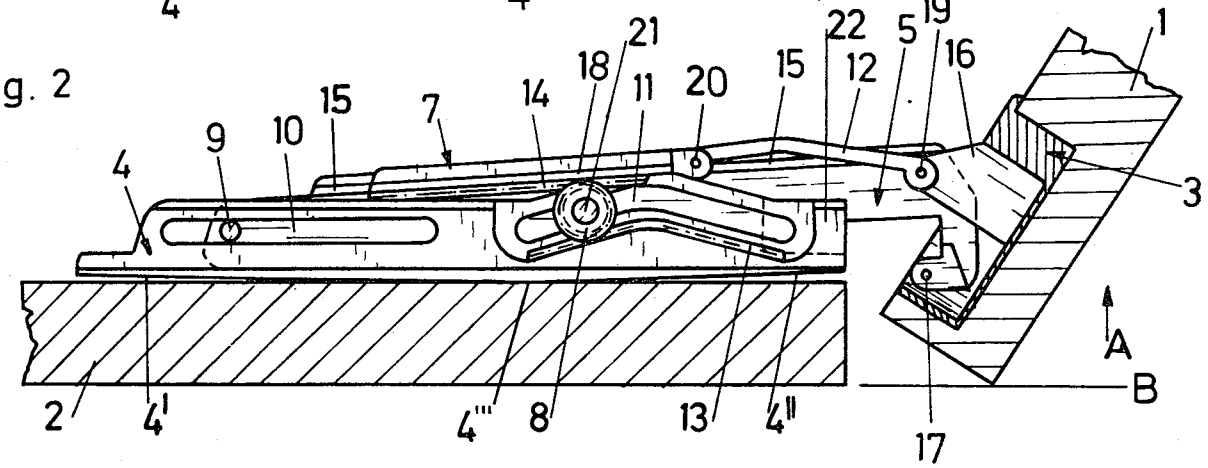
Figure 3:
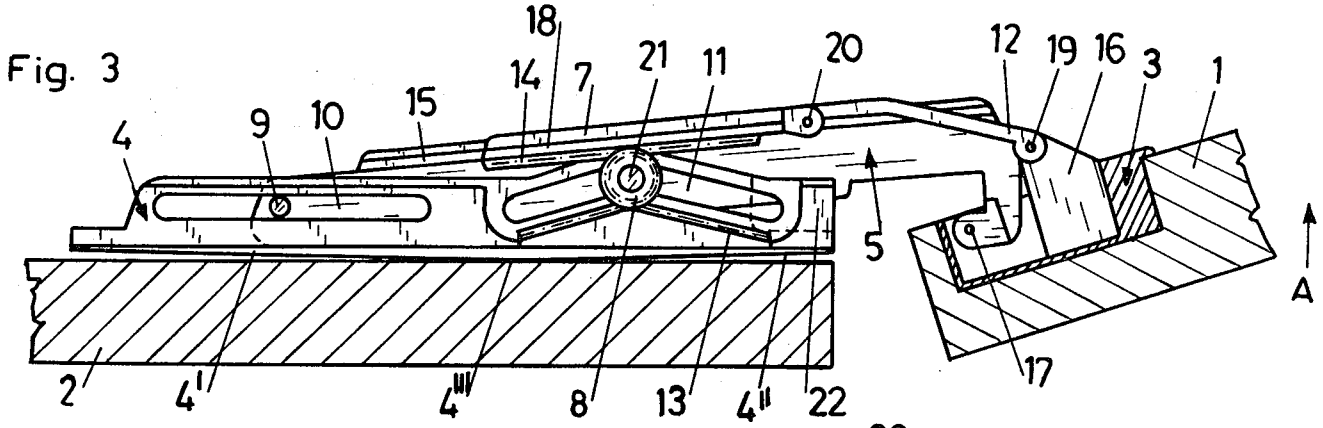
Figure 4:
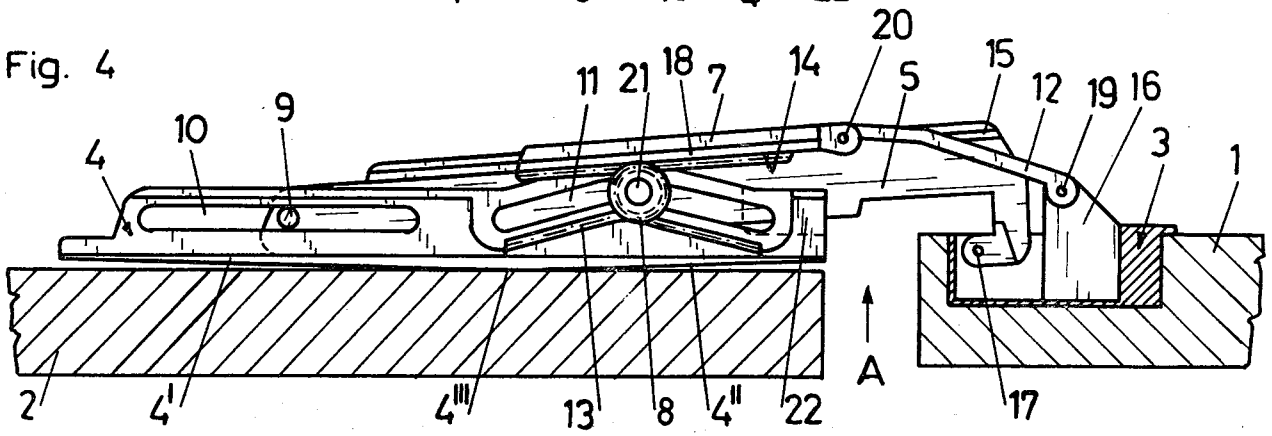
Figure 5:
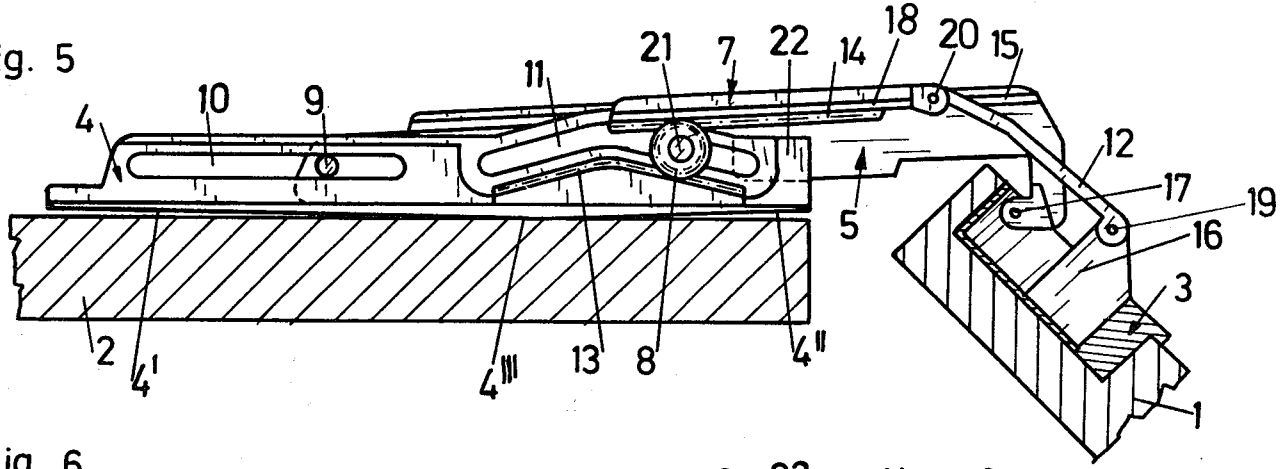
Figure 6:
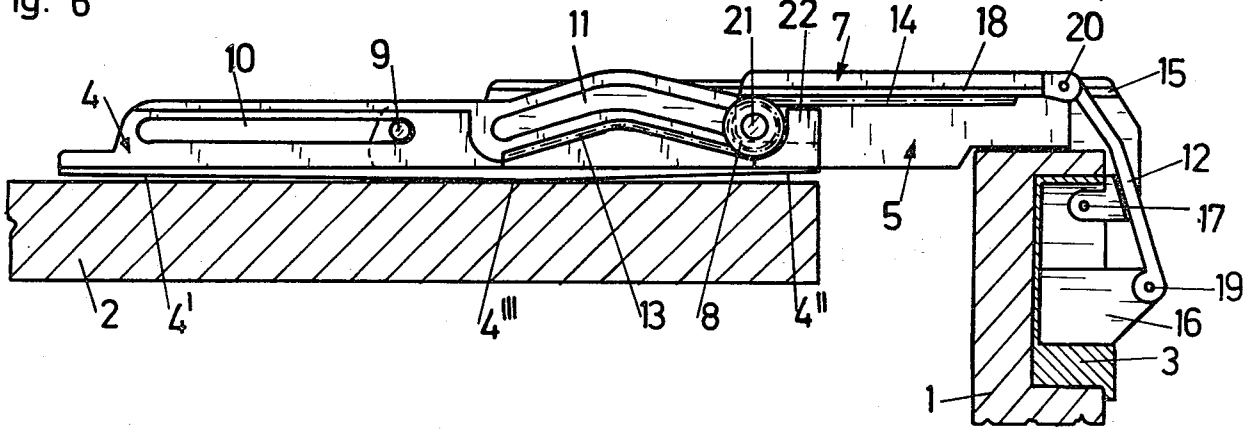
Figure 7:
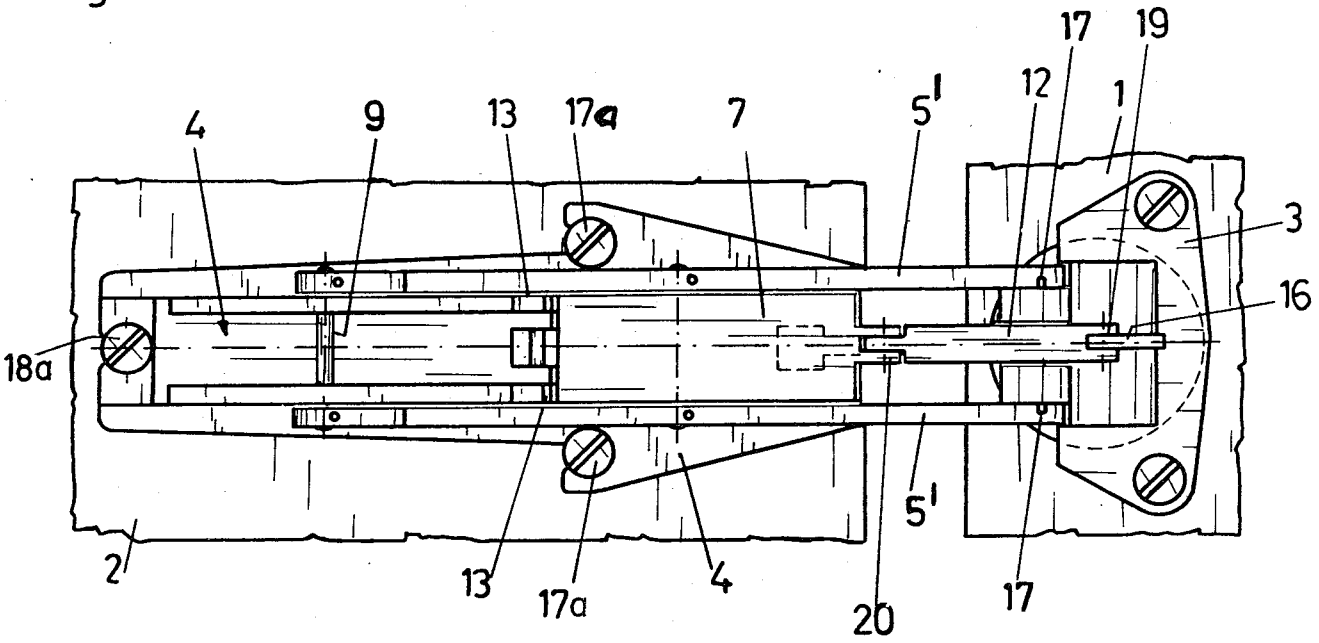
FIG. 7 is a top view of a hinge according to the invention shown in the 90° open position.

The hinge according to the invention comprises a base plate 4 fastenable to a furniture side wall 2 and a hinge casing 3 insertable into a door 1.

The hinge casing 3 and the base plate 4 are coupled to each other by means of hinge arms 5 and 12. The hinge arm 5, which in the embodiment according to FIGS. 1 through 10 includes two hinge arm members 5' arranged along opposite sides of the base plate 4, is coupled to the hinge casing 3 by means of the hinge axle 17.

On the side of the furniture body, the hinge arm 5 is mounted in a slide way 10 in the base plate 4 by means of an axle 9 linking the two hinge arm members 5' and forming a point of connection. The slide way 10 is formed by one or two slots in the base plate 4.

The hinge arm 12 is coupled to the hinge casing 3 by means of an axle 19, i.e. to a projection or seat 16 projecting from the hinge casing 3. On its other side, the hinge arm 12 is fastened to a slide 7 by means of an axle 20. The slide 7 is mounted in the hinge arm 5, i.e. the slide is provided with lateral flanges 18 extending into grooves 15 of the hinge arm members 5', whereby the slide 7 is movably arranged in the hinge arm 5.

Approximately in its center, the hinge arm 5 is provided with an axle 21 forming the second point of connection. In the first embodiment, the axle 21 at opposite ends thereof carries toothed wheels or gear wheels 8.

Axle 21 extends through a slide way 11 in the base plate 4, slide way 11 being of approximately V-shaped configuration, as can be seen from the drawings.

Below the slide ways 11 are arranged on each side of the base plate 4 respective racks 13.

The slide 7 is also provided with one or two racks 14, each toothed wheels 8 mating with respective racks 14 and 13.

When the door 1 is opened, the slide 7 is pulled out of the body of the piece of furniture by the hinge arm 12.

Hence, the slide 7 rotates the toothed wheels 8, which move on the racks 13 of the base plate 4. The hinge arm 5 is, thus, moved forward on the base plate 4, and the slide 7 moves at the time twice the distance of movement of the hinge arm 5.

Because of the special design of the slide way 11, i.e. its V-shaped curvature, the hinge arm 5 and, hence, all coupling points of the hinge casing 3 are lifted from the furniture side wall 2 in the direction of arrow A during the opening process. It is, therefore, possible to open the door 1, even when a second door or another hindrance lies adjacent to the door 1. This has been indicated in FIGS. 1 and 2 by B. The curvature of the slide way could also describe the three shorter sides of a trapezoid.

The base plate 4 is, at its front face directed towards the door 1, provided with a recess 22. When the door 1 is closed, the seat 16 of the hinge casing 3 extends into recess 22.

By dimensioning the breadth of the recess 22 in such a manner that the seat 16 fits closely therein, additional guiding and retaining means for adjusting the height of the piece of furniture are provided for the closed wide angle hinge. Moreover, the weight of the door 1 is transferred to the base plate 4 not exclusively by the hinge arm axles and the hinge arms.

Figure 9:
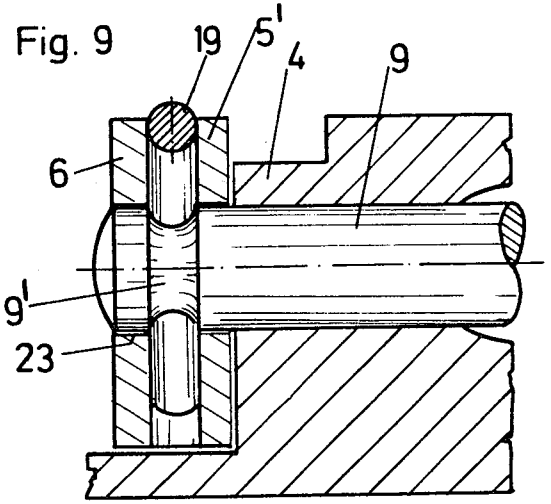
FIG. 9 is a sectional view along line IX—IX of FIG. 8.
Figure 8:
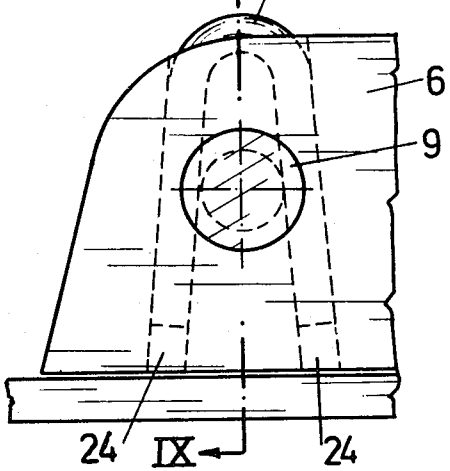
FIG. 8 is a side view of the connection between a hinge arm axle and the hinge arm.
Figure 10:
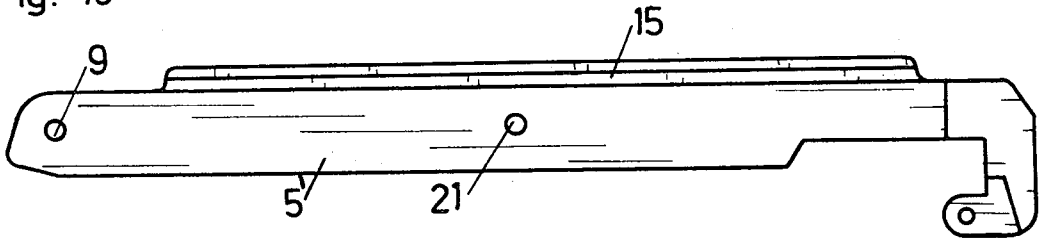
FIG. 10 is a side view of a part of the hinge arm seen from the center of the hinge.

FIGS. 8 and 9 show the manner of fastening the axle 9 to the hinge arm members 5'. Each end of axle 9 extends through an aperture 23 in the respective hinge arm member 5' and has a tapered portion 9' in the region of the hinge arm member 5'.

Channels 24 are provided in the hinge arm member 5'. A spring 19 engaging the annular groove of the axle 9 formed by the tapered portion 9' extends into channels 24. Due to the fact that the channels 24 converge towards the top, the spring 19 must be slightly pressed together, when being inserted. When the spring has been inserted into the channels 24 to a certain extent, the spring 19 is automatically pulled into the position illustrated in the drawings.

Figure 11:
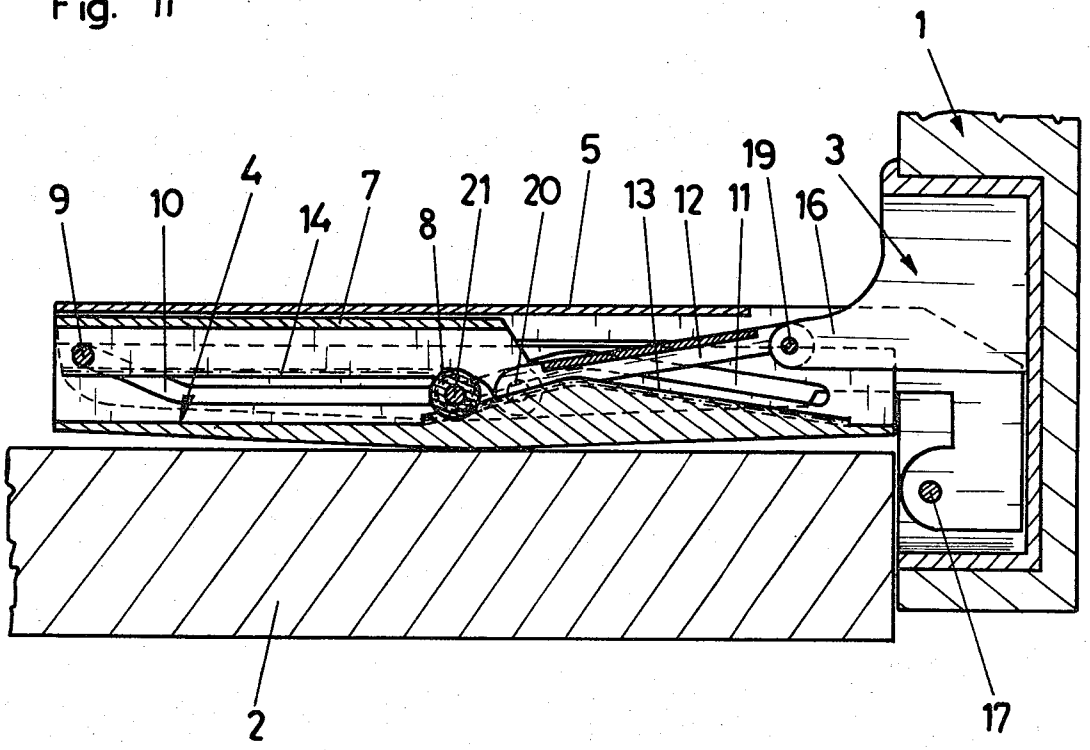
FIG. 11 is a side view of a second embodiment of a hinge of the invention, shown in the closed position.
Figure 12:
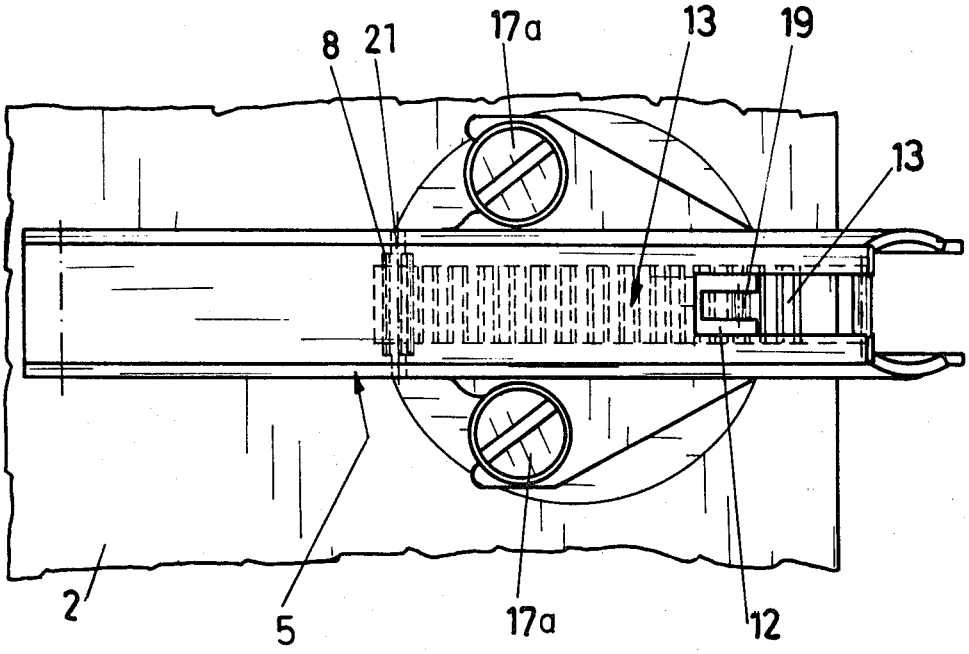
FIG. 12 is a top view thereof.
Figure 13:
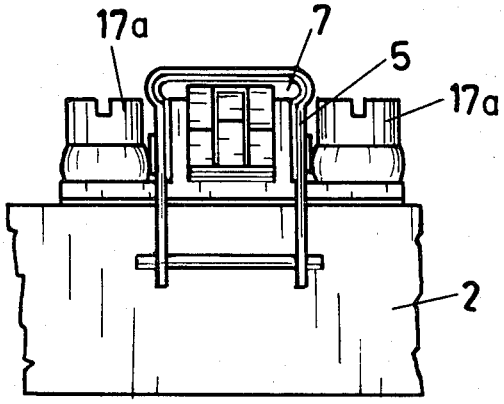
FIG. 13 is a front view thereof, shown without the hinge casing.

In the embodiment according to FIGS. 11 through 13, only one toothed wheel or toothed roll 8 is mounted on the hinge arm 5. Toothed wheel 8 is concentrically arranged and lies between two lateral flanges of the base plate 4, the slots 10 and the slots for the slide way 11 being arranged in such flanges.

In this embodiment, the slots for the slide way 11 and for the rear slide way 10 extend into one another, and, hence, form a common continuous slot 10, 11 on each side of the base plate 4.

On the rear end, the slot 10 turns slightly upwards, i.e. it extends slightly upwardly from the mounting plane. Hence, the rear end of the hinge arm 5 is lowered first, when the hinge is opened. A particularly advantageous motion of the hinge arm 5 is, thus, obtained.

The rack 13 is concentrically arranged on the base plate 4.

In this embodiment, the hinge arm 5 is of one piece and is of U-shaped cross-section. The slide 7 is inserted into the U-shape from one end of the hinge arm 5 and is covered by the hinge arm 5 when the hinge has been assembled.

The base plate 4 is retained on the furniture side wall 2 by means of two screws **17*a* and an adjusting screw 18*a*. The mounting face of the base plate 4 is designed to comprise two sections 4' and 4'' meeting in a supporting rim 4''' aligned parallel to the rotational axis of the wide angle hinge. In the illustrated imbodiments, the base plate 4 is tiltable about the rim 4''' on the furniture side wall 2**.

In the regions of the screws **17*a*, 18*a* the base plate 4 is provided with U-shaped recesses which are open on one side, i.e. it is possible to screw the screws 17*a*, 18*a* into the furniture side wall 2 and to insert, subsequently, the base plate 4 together with the hinge arms below the heads of screws 17*a*, 18*a***.

Because of the tiltable arrangement of the base plate 4 it is possible to effect a side adjustment of the hinge by turning the adjusting screw **18*a*. Subsequently, the screws 17*a*** are fastened.

The screws **17*a*** obviously can be replaced by dowels.

What is claimed is:

1. A furniture hinge having an opening angle of approximately 180°, said hinge comprising:

a base plate adapted to be fastened to a wall of an article of furniture;

a hinge casing adapted to be fastened to a furniture door;

a first hinge arm pivotally connected to said hinge casing and mounted for sliding movement with respect to said base plate;

a slide member;

means mounting said slide member on said first hinge arm for sliding movement in a longitudinal direction with respect thereto;

a second hinge arm having a first end pivotally connected to said hinge casing and a second end pivotally connected to said slide member;

whereby pivoting movement of said hinge casing with respect to said base plate causes said second hinge arm to move said slide member longitudinally with respect to said first hinge arm;

a first rack on said slide member;

a second rack fixed with respect to said base plate;

gear wheel means, mounted on said first hinge arm and in meshing engagement with said first and second racks, for, in resonse to sliding movement of said slide member longitudinally with respect to said first hinge arm, causing said first hinge arm to slide with respect to said base plate; and means for connecting said first hinge arm and said base plate and for guiding sliding movement of said first hinge arm with respect to said base plate, said connecting and guiding means comprising a first slide way portion fixed with respect to said base plate at an outer position relatively adjacent said hinge casing, a second slide way portion fixed with respect to said base plate at an inner position relatively spaced from said hinge casing, and engaging means on said first hinge arm extending into said first and second slide way portions for causing said sliding movement of said first hinge arm to follow the contour of said slide way portions, said first slide way portion having a curved contour such that upon opening or closing movement of said hinge casing with respect to said base plate, said first hinge arm, said slide member, said second hinge arm and said hinge casing are moved in a direction away from and generally normal to the mounting plane of said base plate.

2. A hinge as claimed in claim 1, wherein said second rack is curved and follows the contour of said first slide way portion.

3. A hinge as claimed in claim 1, further comprising an axle mounting said gear wheel means on said first hinge arm, said engaging means including a portion of said axle extending into said first slide way portion.

4. A hinge as claimed in claim 1, wherein said first and second slide way portions respectively comprise a first pair of curved slots on opposite lateral sides of said base plate relative to said longitudinal direction and a second pair of slots on opposite lateral sides of said base plate relative to said longitudinal direction.

5. A hinge as claimed in claim 4, comprising a pair of said first racks on opposite lateral sides of said slide member relative to said longitudinal direction, a pair of said second racks on opposite lateral sides of said base plate relative to said longitudinal direction, and said gear wheel means comprises a pair of gear wheels on opposite lateral sides of said first hinge arm relative to said longitudinal direction in meshing engagement with respective of said first and second racks.

6. A hinge as claimed in claim 5, wherein said engaging means includes an axle supporting said gear wheels on said first hinge arm and extending into said first pair of curved slots.

7. A hinge as claimed in claim 6, wherein said engaging means further includes another axle supported on said first hinge arm and extending into said second pair of slots.

8. A hinge as claimed in claim 1, wherein said first and second slide way portions respectively comprise a first curved portion and a second portion of a single slot on at least one side of said base plate.

9. A hinge as claimed in claim 8, wherein said engaging means includes an axle supporting said gear wheel means on said first hinge arm and extending into said first curved portion of said single slot.

10. A hinge as claimed in claim 9, wherein said engaging means further includes another axle supported on said first hinge arm and extending into said second portion of said single slot.

11. A hinge as claimed in claim 1, wherein said contour of said first slide way portion includes a vertex which coincides with a part of said first slide way portion furthest spaced from said mounting plane of said base plate.

12. A hinge as claimed in claim 1, wherein said mounting means comprises flanges on opposite sides of said slide member, said flanges slidably fitting into respective longitudinal grooves in said first hinge arm.

13. A hinge as claimed in claim 1, wherein said first end of said second hinge arm is pivotally connected to a projection extending from said hinge casing.

14. A hinge as claimed in claim 13, wherein said base plate has therein a recess, said projection of said hinge casing fitting within said recess when said hinge casing is in a closed position.

* * * * *